US011648696B1

(12) United States Patent
Friedman

(10) Patent No.: US 11,648,696 B1
(45) Date of Patent: May 16, 2023

(54) VARIABLE NUMBER OF BLADES HAIR SHAVING INSTRUMENT

(71) Applicant: Michael Friedman, Belton, TX (US)

(72) Inventor: Michael Friedman, Belton, TX (US)

( * ) Notice: Subject to any disclaimer, the term of this patent is extended or adjusted under 35 U.S.C. 154(b) by 30 days.

(21) Appl. No.: 17/200,494

(22) Filed: Mar. 12, 2021

Related U.S. Application Data

(60) Provisional application No. 62/988,401, filed on Mar. 12, 2020.

(51) Int. Cl.
*B26B 21/22* (2006.01)
*B26B 21/40* (2006.01)
*B26B 21/52* (2006.01)

(52) U.S. Cl.
CPC ..... *B26B 21/225* (2013.01); *B26B 21/4018* (2013.01); *B26B 21/521* (2013.01)

(58) Field of Classification Search
CPC .... B26B 21/521; B26B 21/408; B26B 21/225
See application file for complete search history.

(56) References Cited

U.S. PATENT DOCUMENTS 775,134 A 11/1904 Gillette
1,234,834 A * 7/1917 Warren ..... B26B 21/4037 30/47
1,920,711 A * 8/1933 Pelizzola ..... B26B 21/22 30/50
2,385,859 A * 10/1945 Jacobson ..... B26B 21/40 30/296.1
3,832,432 A 8/1974 Perry
3,950,848 A * 4/1976 Goldstein ..... B26B 21/225 30/47
4,831,731 A 5/1989 Elits
5,222,300 A 6/1993 Althaus et al.
5,412,872 A 5/1995 Iderosa
5,501,014 A * 3/1996 Hegemann ..... B26B 21/4068 30/346.5

(Continued)

FOREIGN PATENT DOCUMENTS

KR 20120130818 A * 12/2012

OTHER PUBLICATIONS

Joe Borrelli, Saiver 2.0 Twin Blade Double Edge Safety Razor, Jun. 9, 2017 https://sharpologist.com/saiver-2-0-safety-razor-twin-blade-double-edge-safety-razor/.

(Continued)

*Primary Examiner* — Evan H MacFarlane
*Assistant Examiner* — Liang Dong

(57) ABSTRACT

A razor including a head and a handle attached to the head via a pivot mechanism. An adjustable spring is used to orient the head. The head includes a top member, a bottom member, and one or more pins to retain a blade stack between the top member and the bottom member, the blade stack to comprise at least one razor blade and at least one spacer. The head also includes at least one removable fastener to enable the user to fasten the top member and the bottom member around the blade stack. The handle may be made of multiple segments with a common connection type making it reconfigurable by the user. The head may have channels to allow a fluid, gel or product from a cavity in the handle to the surface of the head. The handle may have a magnet at the end or in the last segment.

4 Claims, 14 Drawing Sheets

(56) References Cited

U.S. PATENT DOCUMENTS

| | | | | |
|---|---|---|---|---|
| 5,524,347 | A | 6/1996 | Prochaska | |
| 5,590,468 | A | 1/1997 | Prochaska | |
| 5,911,480 | A | 6/1999 | Morgan | |
| 6,161,288 | A | 12/2000 | Andrews | |
| 6,473,970 | B1 | 11/2002 | Prochaska | |
| 6,568,084 | B2 | 5/2003 | McCool et al. | |
| 6,725,550 | B1 | 4/2004 | Shah | |
| 6,769,180 | B2 | 8/2004 | Coffin | |
| 6,880,253 | B1 | 4/2005 | Gyllerstrom | |
| 6,915,580 | B2 | 7/2005 | Dassel | |
| 7,028,407 | B2 | 4/2006 | Ehrlich | |
| 7,047,646 | B2 | 5/2006 | Coffin | |
| 8,438,735 | B2 | 5/2013 | De Klerk | |
| 9,308,658 | B2 | 4/2016 | Coviello | |
| 9,579,809 | B2 | 2/2017 | Hawes | |
| 9,604,377 | B2 | 3/2017 | Tong | |
| 10,647,012 | B2 | 5/2020 | Robertson | |
| 10,863,803 | B2 | 12/2020 | Strum | |
| 2003/0177648 | A1* | 9/2003 | Zeiter | B26B 21/523 30/526 |
| 2004/0107585 | A1 | 6/2004 | Helmrich | |
| 2005/0126008 | A1* | 6/2005 | Pennella | B26B 21/446 30/41 |
| 2012/0325236 | A1 | 12/2012 | Macove | |
| 2016/0121497 | A1 | 5/2016 | Johnson | |
| 2016/0144519 | A1 | 5/2016 | Hahn et al. | |
| 2019/0084169 | A1 | 3/2019 | Bonk | |
| 2020/0070376 | A1 | 3/2020 | Petratou | |
| 2020/0238550 | A1 | 7/2020 | Sarve | |

OTHER PUBLICATIONS

MJClark, Post #15, Jul. 21, 2016, https://www.badgerandblade.com/forum/threads/review-of-the-saiverd-profimed-from-russia-dual-blade-open-comb-safety-bar-razor.391638/.

Smedley, Double Layer—DE Razor?, Post#10, Badger and Blade, Jul. 13, 2007, https://www.badgerandblade.com/forum/threads/double-layer-de-razor.22750/.

The Mvltiplex Razor: A Marriage of Art & Machine, At least as early as Nov. 27, 2019, http://www.geocities.ws/safetyrazors/Multiplex/mvltiplex.htm.

EFSK, Shaving Universe, Sep. 24, 2019, https://shavinguniverse.com/community/threads/mvltiplex.2358/.

Michael Friedman, Sep. 15, 2022, Savier 2.0 Razor Disclosure.

* cited by examiner

VARIABLE NUMBER OF BLADES HAIR SHAVING INSTRUMENT

CROSS-REFERENCE TO RELATED APPLICATIONS

This application claims the benefit of U.S. Provisional Patent Application Application No. 62/988,401, filed Mar. 12, 2020 by Michael Friedman, which is incorporated herein by reference in its entirety.

TECHNICAL FIELD

The present invention relates to the field of shaving razors and more particularly to manual shaving devices that utilize no motors or electricity.

BACKGROUND

The majority of manual razors used today for personal grooming where the handle is reusable fall into one of two categories. There are classic safety razors, where the blade is replaceable and the head and handle are reusable, and there are cartridge razors, where the whole head is replaced when the shaving performance deteriorates.

Classic safety razors generally only have one or two blades. While they are generally found to be more economical than cartridge razors, they have several drawbacks. Classic safety razors typically only have one or two blades and cannot offer the shaving experience that a 3 or more bladed cartridge razor can. More blades provide a closer shave and can reduce skin irritation. Also, many classic safety razors had problems aligning the blades, required modifying the blades to install them in the razor, or required a unique blade for each blade location in the head. Classic safety razors typically do not have a pivoting mechanism which increases the skill level required by the user. Pivoting heads, found on modern cartridge razors, help ensure the user is always using the correct angle between the blades and their skin. It is also easy for users to injure themselves on classic safety razors. Excess pressure during shaving can lead to cuts. Even just handling the blades can lead to injury as the blades must be loaded onto the razor by hand. Picking a razor blade up off of a counter or floor can be very difficult to do without injury to the user. Another problem with classic safety razors is that they lack any form of lubrication. The user will typically apply shaving gel, cream, or other products to act as a lubricant on their face. This is both a time consuming process and leaves the user's hands messy.

Cartridge razors solve a lot of the problems mentioned above. They have a pivot to adjust the angle and a guard to reduce excess pressure on the blades. They have a three dimensional profile so they are easier to pick-up off of surfaces and floors without injury. They typically have lubricating strips to improve the comfort during the shave. While they have a lot of advantages over the classic shaving razor, they suffer from two major draw backs. The cartridges generally cost more to replace than the blades of classic shaving razors. They also generate a lot of waste. Each cartridge razor represents one configuration. If a user wants to try a different razor, they generally have to buy a new handle. Also, if the spring wears out, they have to buy a new handle. This leads to a lot of razor handles ending up in landfills. Most razors come with some sort of stand. These stands frequently get lost or break. Even when they last, many are designed only to accept the razor that stand comes with. All of this leads to more waste in landfills.

What is needed is a razor that competes on cost with a classic safety razor; offers the performance, comfort, quality, and safety of a modern cartridge razor; reduces disposable and non-reusable components; and offers a wider range of shaving experiences all within the same design and components.

DETAILED DESCRIPTION

The present disclosure describes a re-configurable or customizable hair shaving instrument (i.e., a "razor apparatus," or simply a "razor") that can be adjusted by the end user to best fit the end user's needs or preferences.

Figure 1:
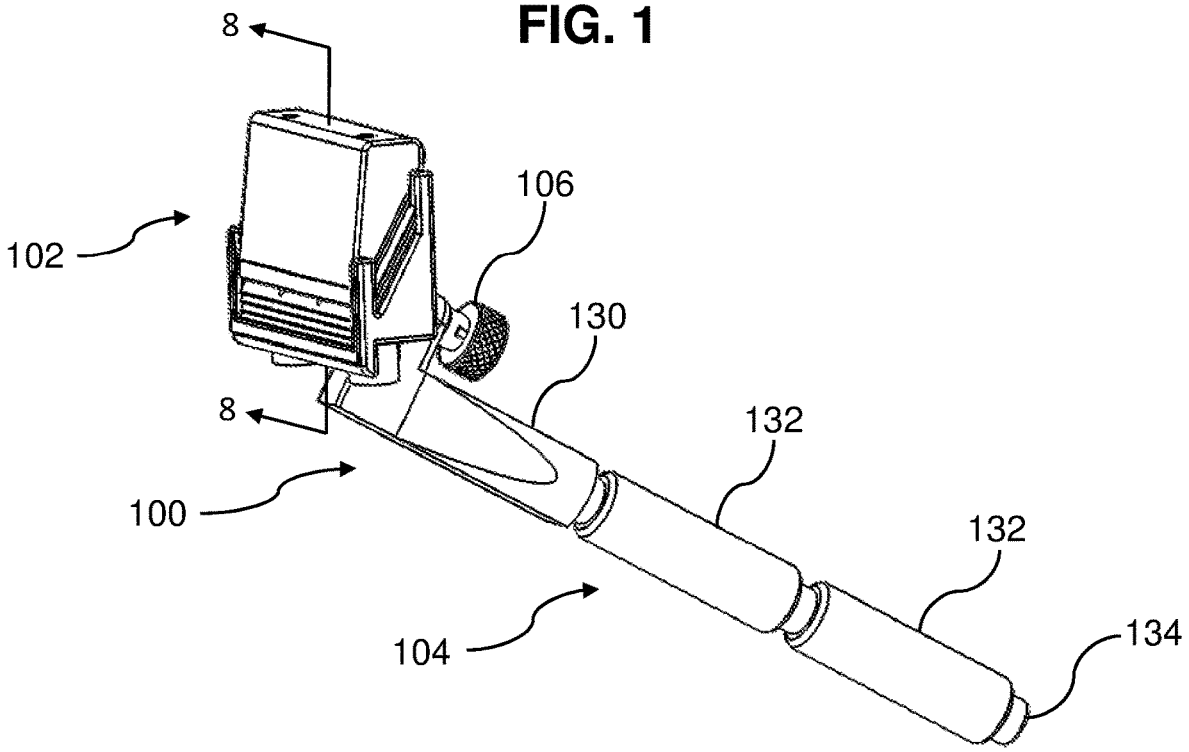
FIG. 1 presents an isometric view of a hair shaving instrument with a variable number of blades according to one embodiment.
Figure 2:
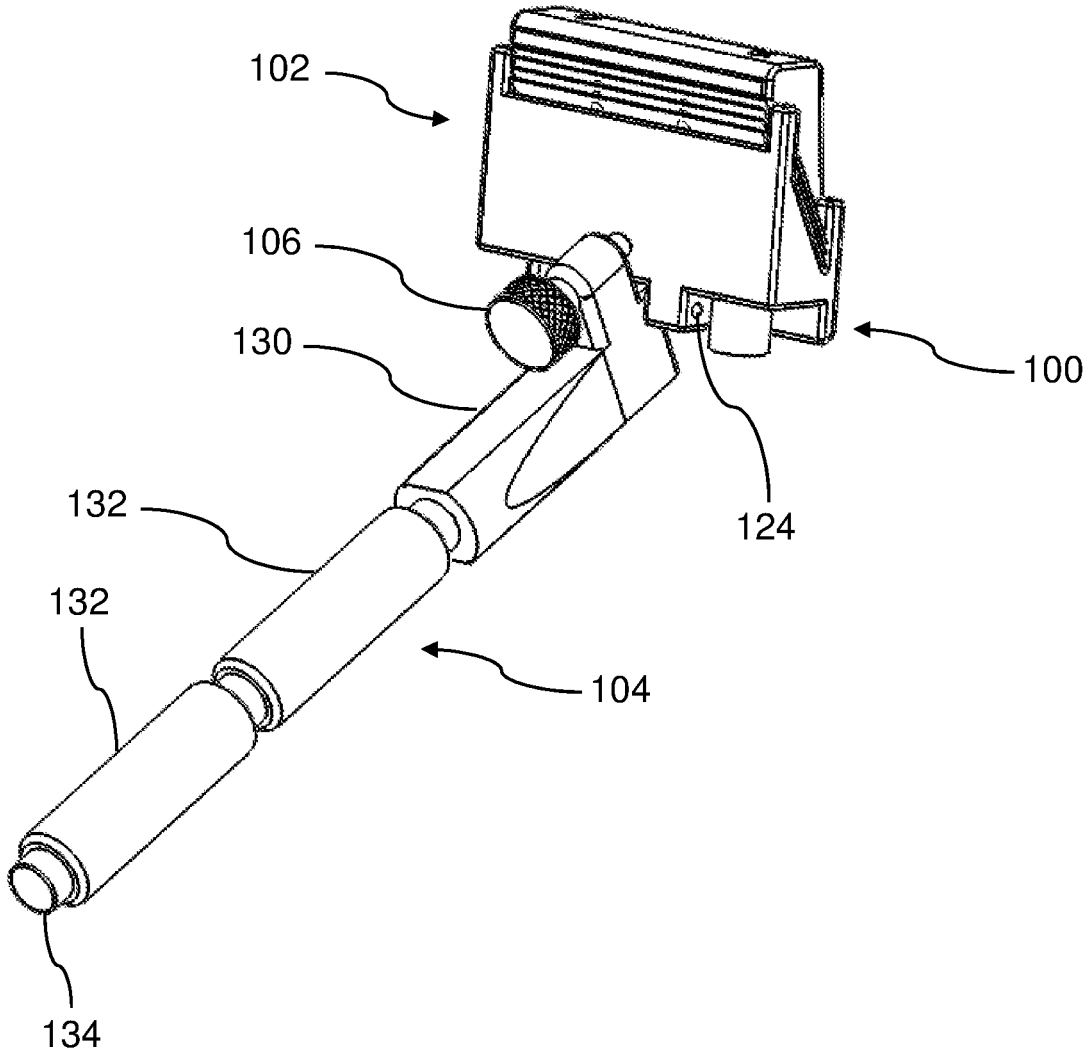
FIG. 2 presents an isometric view of the hair shaving instrument of FIG. 1 from another angle.
Figure 3:
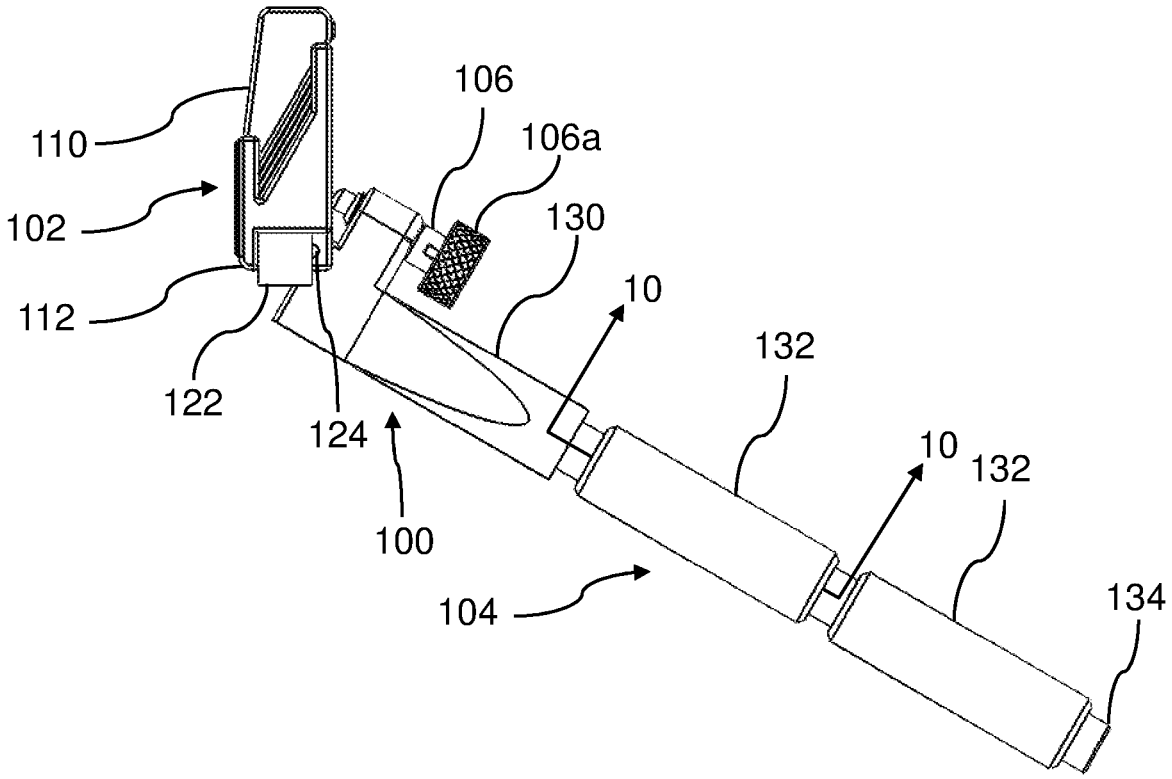
FIG. 3 presents a side view of the hair shaving instrument of FIG. 1.

FIGS. 1-3 illustrate an example embodiment of a razor apparatus 100. The razor 100 comprises a head 102 and a handle 104. A rigid or pivot connection or joint may be used to connect the head 102 to the handle 104. A spring plunger 106 may be used to drive the head in one direction, to a desired orientation, or a desired position; but in other embodiments, other springs or spring apparatuses could be used such as a torsion spring. In one embodiment, the spring plunger 106 contains a spring that drives a plunger to an extended position, and the plunger travels relative to an externally threaded body that is threaded into the handle. The plunger end engages the head. The plunger end can vary in shape, and the length of travel can vary in different embodiments. A knob style spring plunger is shown but other types of spring plungers could be used in other embodiments.

Figure 4:
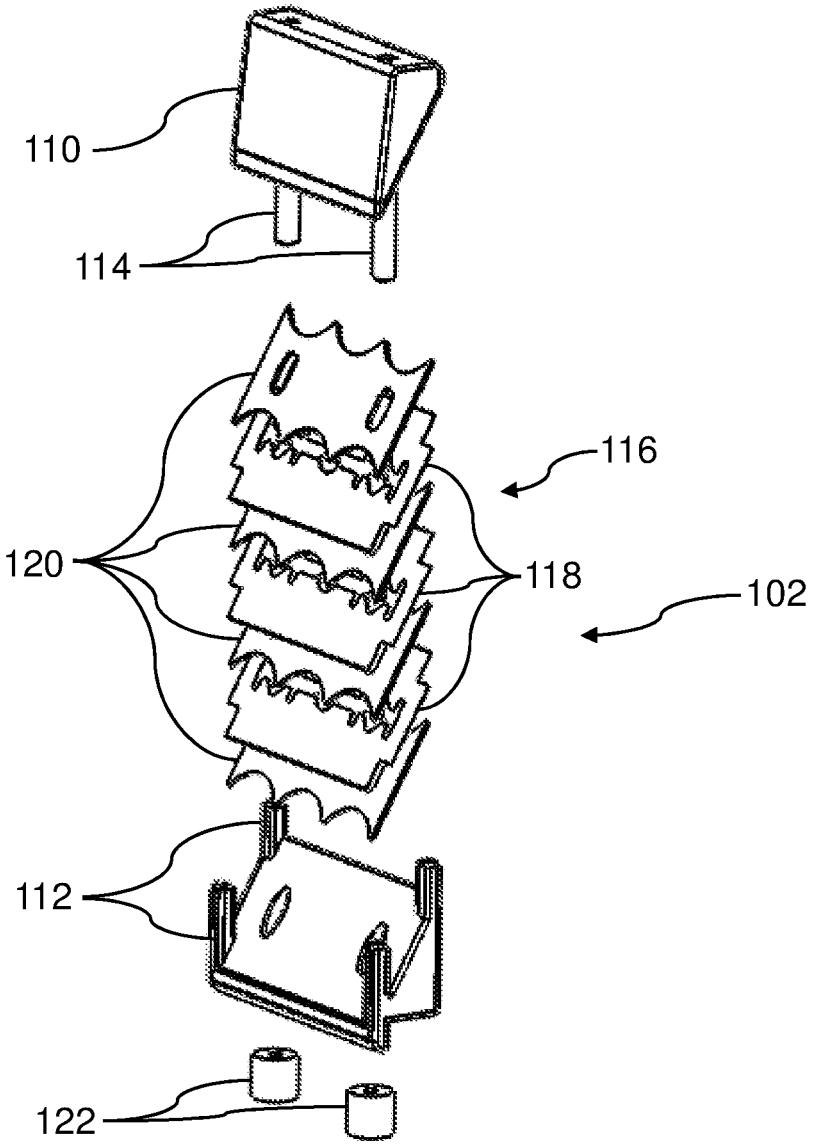
FIG. 4 presents an exploded view of the head of the hair shaving instrument of FIG. 1.

FIG. 4 is an isometric exploded view of the head 102. In the illustrated embodiment, the upper member, upper body, or cap 110 of the head 102 connects to the lower member, lower body, or base 112 of the head 102 by two pins, rods, or male fastening elements 114. However, in other embodiments one pin may be used to connect the cap to the base, or three pins may be used to connect the cap to the base. Disposed between the cap 110 and the base 112 is a user configurable assembly or stack 116 of razor blades 118 and spacers 120. For purposes of this disclosure, a stack of one or more razor blades and one or more spacers may be referred to as a "cutting stack" 116. In the illustrated embodiment, the cutting stack 116 is made up of multiple identical razor blades 118 and multiple identical spacers 120. However, in other embodiments, a cutting stack may use razor blades with a different shape and/or spacers with a different shape. Also, in other embodiments, the spacers in a stack may not all be the same shape and size. The number and dimensions of spacers 120 between each razor blade 118, between a razor blade 118 and the cap 110, and between a razor blade 118 and the base 112 are not intended to be limited. In other words, the design of the head 102 allows a user to customize the cutting stack by varying the number of spacers 120 between adjacent razor blades 118, the number of spacers 120 between the top razor blade 118 and the cap 110 of the head 102, and the number of spacers 120 between the bottom razor blade 118 and the base 112 of the head 102. Also, in different embodiments, the razor may be provided to the user as a kit that includes spacers of a particular thickness, such as about 0.020 inches. And different kits may include spacers with a different thickness, such as 0.005 inches. Spacers may also be made available separately. Also, spacers with different thicknesses may be made available. For instance, such thickness may range from 0.001 to 0.100 inches. The razor blades 118 shown are representative of what is commonly known as double-edge safety razor blades, but other embodiments of the razor may be designed or configured to work with other razor blade shapes.

As shown in FIGS. 3 and 4, in some embodiments, the pins 114 may be attached to the cap 110, and the latching components, female fasteners, or nuts 122 attach to the pins 114 beneath the base 112. The female fasteners 122 are shown as a plurality of threaded nuts with a knurled round exteriors but in an alternate embodiment another component could serve the same function, such as a hex nut, a spring loaded latch, or a cam to give some examples; but other possibilities exist, so long as the female fasteners 122 grab the pins 114 and allow an adjustable distance between the cap and the female fastener while applying tension to the pins 114 and thus compression to the whole head assembly 102.

Figure 5:
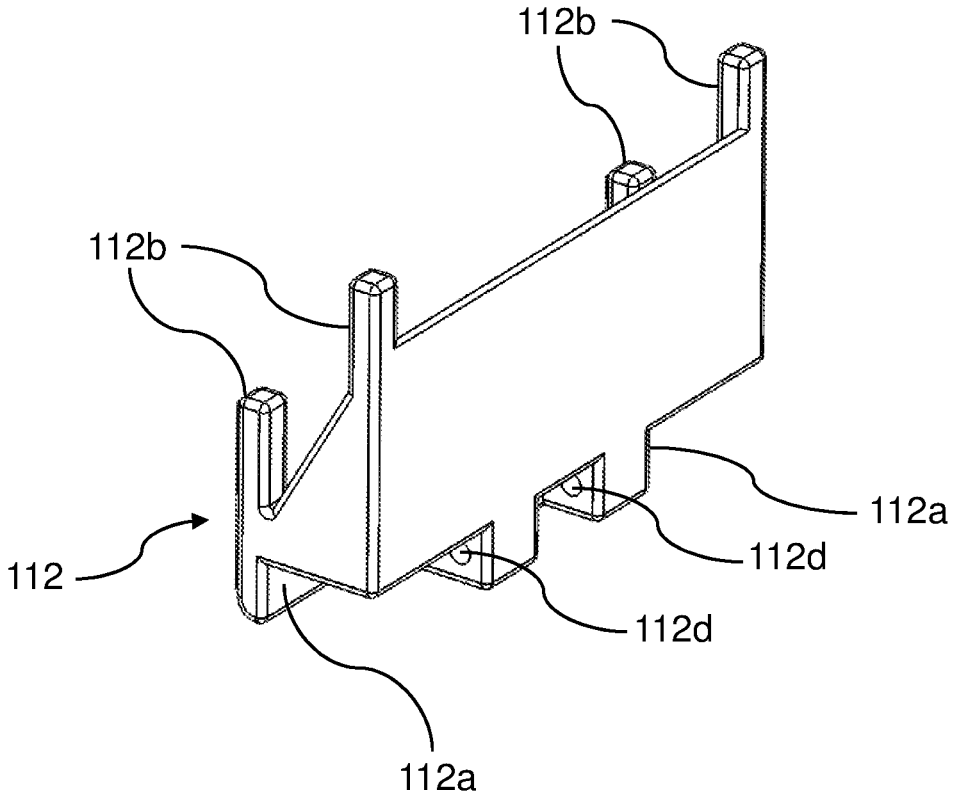
FIG. 5 presents an isometric view of the base of the head of FIG. 4.
Figure 6:
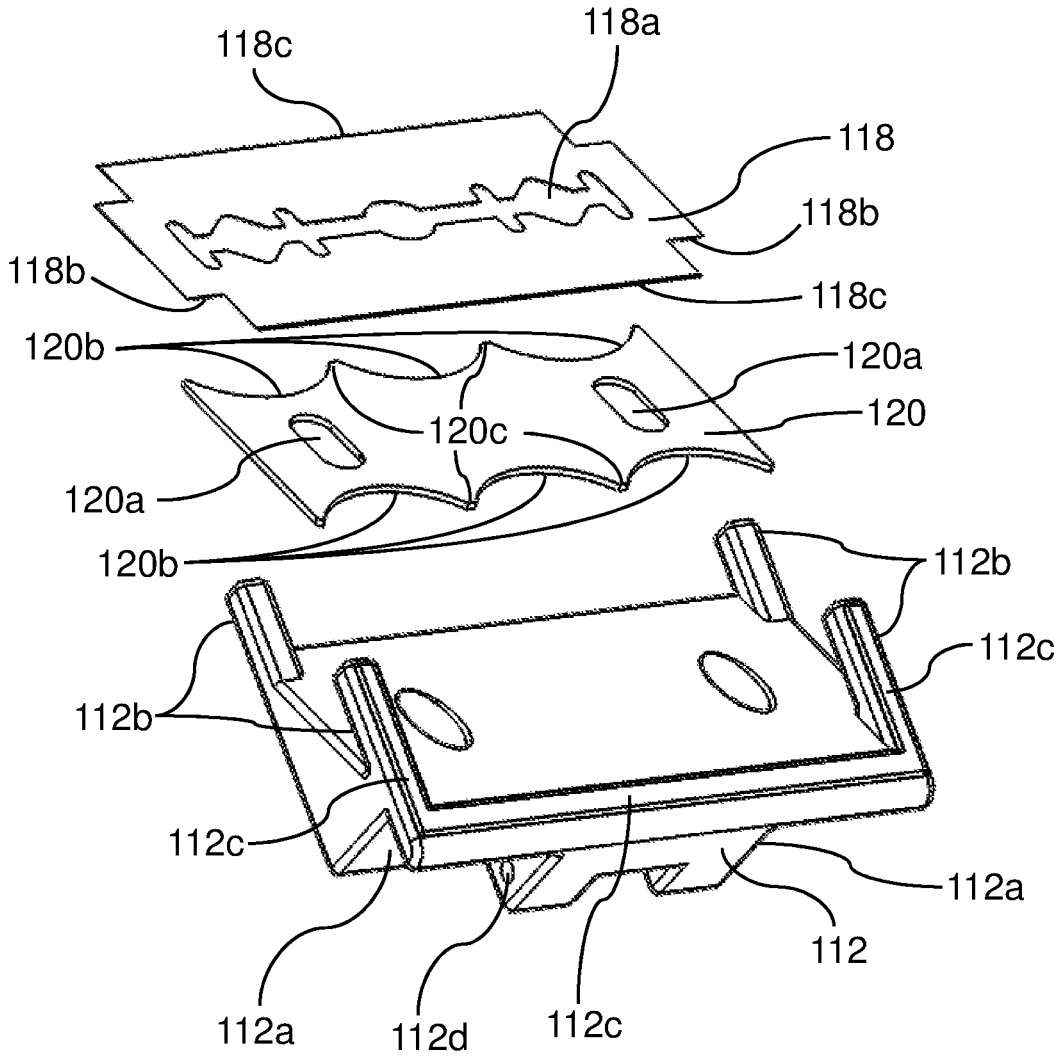
FIG. 6 presents an enlarged exploded view of the base, a spacer, and a razor blade of FIG. 4 from another angle.
Figure 7:
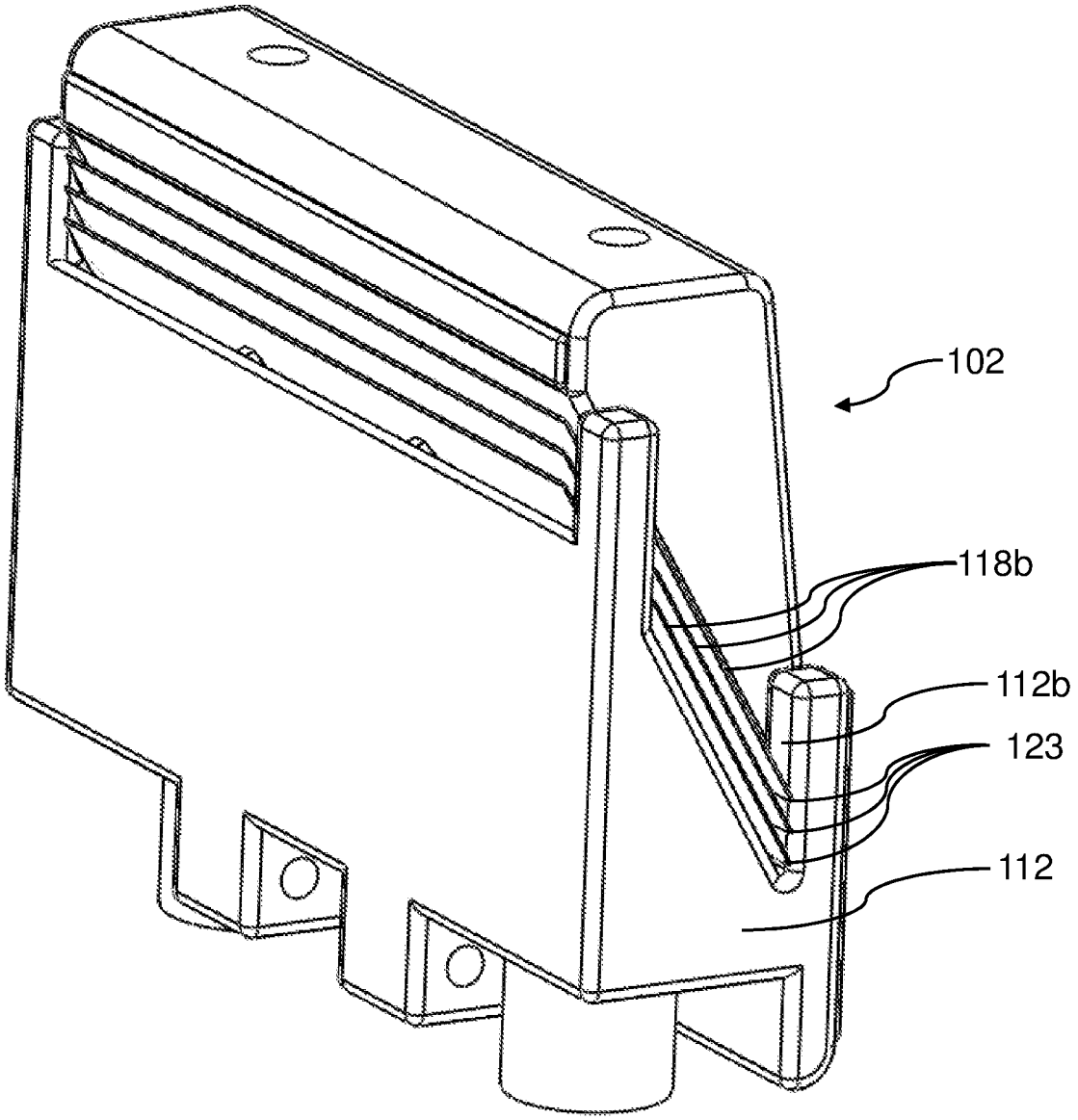
FIG. 7 presents an isometric view of the head shown in FIG. 1 from another angle.

With reference to FIGS. 4-6, the aspect of assembly of the head is addressed. The pins 114 are attached to the cap 110. The pins 114 extend down through openings in the spacers 120*a* and razor blades 118*a*.

The bottom member 112 may contain a plurality of cut outs or recesses 112*a*. The female fasteners 122 grab the pins 114 within the recesses 112*a* and are tightened to compress the plurality of spacers 120 and razor blades 118 between the cap 110 and the base 112. In an alternate embodiment where the recesses 112*a* do not exist but the pins 114 are still attached to the cap 110, the female fasteners 122 would grab the pins 114 below the base 112.

With reference to FIGS. 4-7, tabs 118*b* on the ends of the razor blades 118 contact fingers, protrusions, or prongs 112*b* extending from the base 112. The surfaces of the fingers 112*b* that contacts the razor blades 118 are nominally parallel to the pins 114 but in other embodiments could be angled up to 5 degrees from parallel with the pins 114 when the head 102 is assembled. The lines or points of contact 123 between the razor blade tabs 118*b* and the prongs 112*b* can shift up or down along the prongs 118*b* as a function of the number and configuration of the razor blades 118 and spacers 120 used. In an alternate embodiment, the prongs can extend from the cap 110 parallel to the pins 114 towards the base 112.

Figure 8:
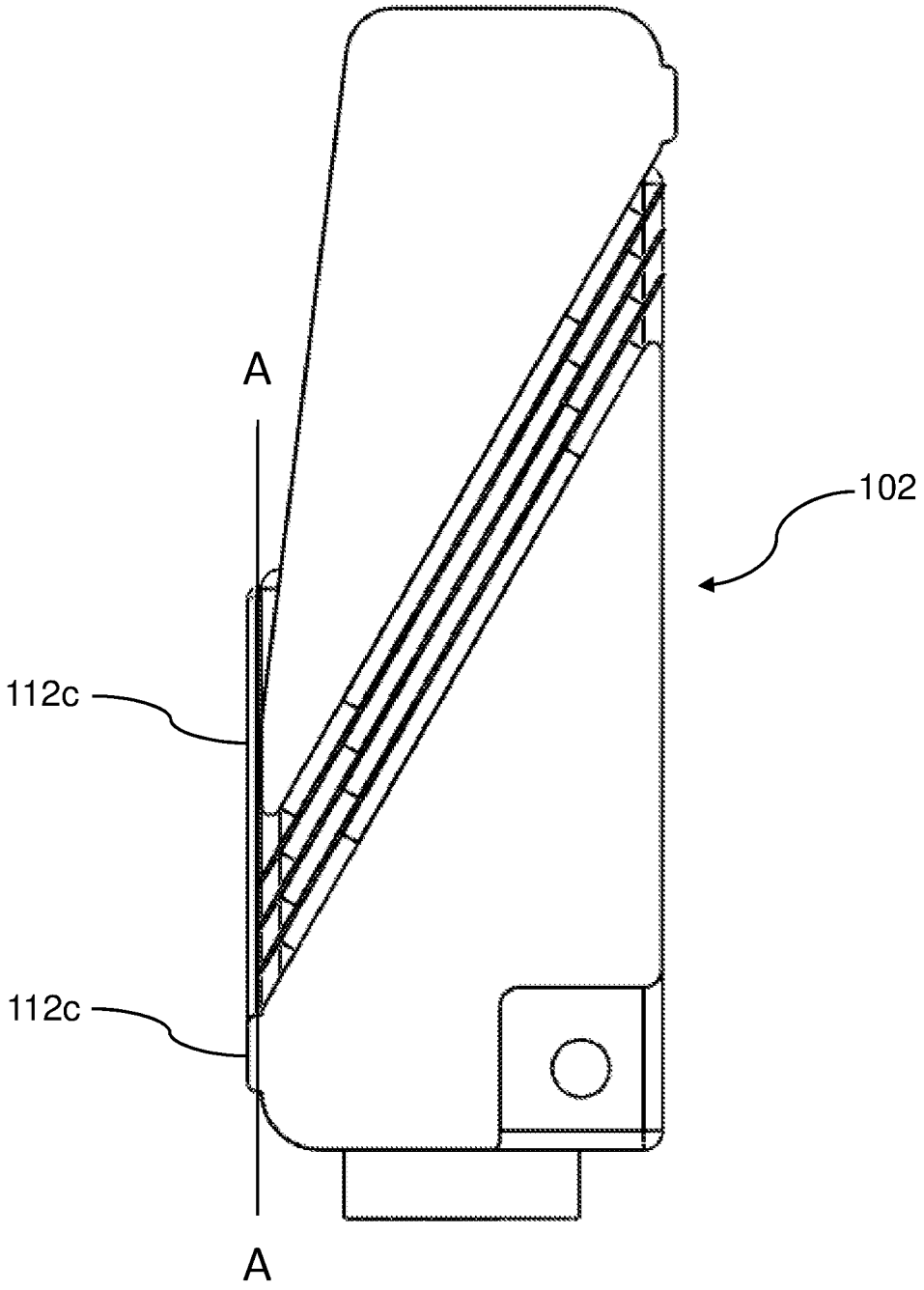
FIG. 8 presents a cross-section view of the head shown in FIG. 1.

As shown in FIGS. 4, 6, and 8, on the base 112, below where the bottom of the stack of blades and spacers 116 sits, is a guard 112*c*. The guard 112*c* is a surface that is flush with or protrudes from the plane or shaving plane A-A constructed by the cutting edges 118*c* of the razor blades 118. The guard 112*c* may be integral with the base 112 and may extend up the prongs 112*b* to the sides of the razor blades 118.

As shown in FIGS. 2-3, 5-6, and 9, the handle assembly 104 is connected to the razor's head 102 by a pivot connection or joint. A pivot pin 124 passes through openings 112*d* in the base 112 and an opening 130*a* in the first handle segment 130. The pivot pin 124 may be located behind the guard 112*c*.

As shown in FIG. 6 each spacer has openings 120*a* to allow the pins to pass through the cutting stack 116 (as shown in FIG. 4). The spacers 120 include points 120*c* which extend out to near the cutting edge of the razor blades 118*c*, and the spacers 120 have recesses 120*b* positioned between the points 120*c*.

Figure 9:
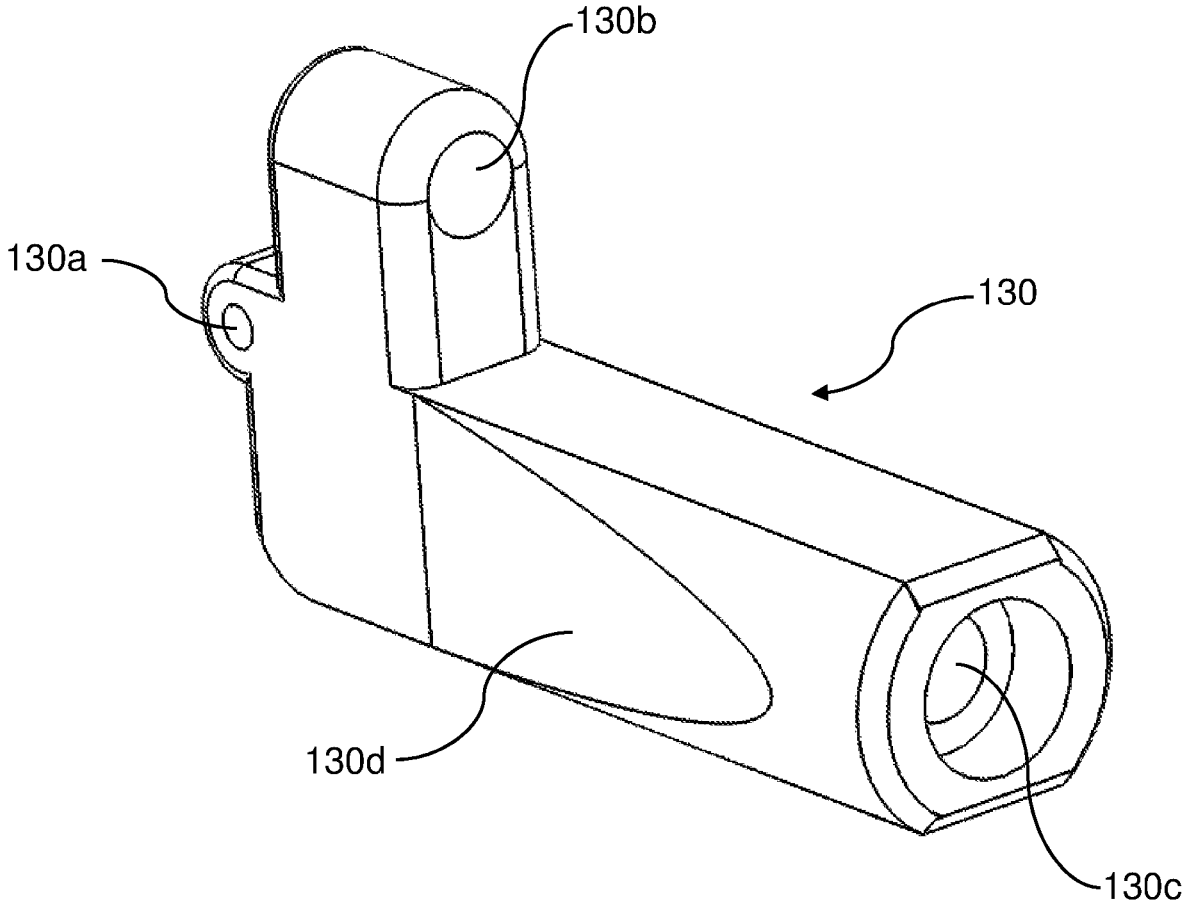
FIG. 9 presents an isometric view of a root handle segment.
Figure 10:
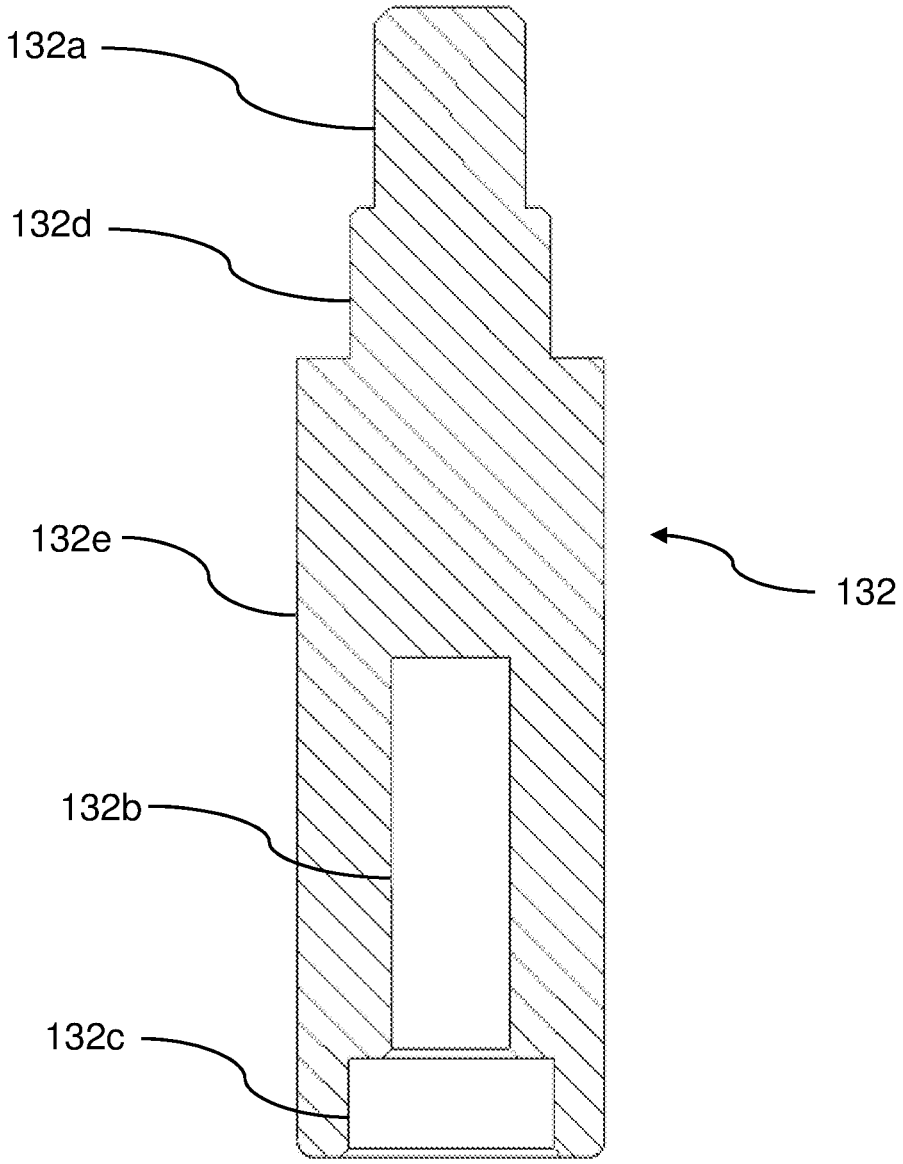
FIG. 10 presents a cross-section view of an extension handle segment shown in FIG. 3.

FIG. 9 is an isometric view of the primary handle segment 130 from the handle 104 of the embodiment of FIG. 1. For purposes of this disclosure, a primary handle segment may also be referred to as a "first handle segment," an "upper handle segment," or a "root handle segment."

FIGS. 2-3 and 9 illustrate an opening 130*a* through which the pivot pin 124 passes. Also, the spring plunger 106 threads into an opening 130*b* at the back of the root handle segment. The spring plunger 106 threads into the opening 130*b* by turning the knob on the spring plunger 106*a*. The user can adjust the distance the spring plunger 106 is threaded into the opening 130*b*. A female connector 130*c* is located at the far end from the pivot opening 130*a*. The female connector 130*c* is sized to receive the male connector from an extension handle segment 132. In this embodiment, the female connector 130*c* is threaded but connections other than threaded connections may be used in other embodiments. For the sake of simplicity, all future references will only be threaded connections but it should be understood that these are interchangeable with other connection types. Two flat and not parallel surfaces 130*d* may be found on opposite sides of the first handle segment 130.

FIGS. 1-3 and 9-10 illustrate an example embodiment of the handle 104. An extension handle segment 132 connects to the root handle segment 130 by inserting the extension handle's male connector 132*a* into the female connector 130*c* of the root handle segment 130. The female connector on the extension handle segment 132 may be the same as the female connector 130*c* on the root handle 130 segment. For instance, the female connector may be made up of a threaded cavity 132*b* and a widened opening 132*c* that is sized to receive a magnet 134 (as shown in FIGS. 1-3). The male end of the extension handle segment may also have a widened section 132*d*. All of the handle segment connections may use the same thread pitch and diameter. As indicated above, extension handle segments may include one end with a male connector and the other end with a female connector. The female connector of the root handle segment may also be referred to as a "root connector." The exterior of the extension handle segment(s) 132*e* is not intended to be limited in diameter, shape, or texture. The common connectors make a variety of extension handle segment embodiments interchangeable. A plurality of embodiments or identical extension handle segments 132 may be used in the assembly by linking each extension handle segment to the next with the male to female connections. The number of extension handle segments used is not intended to be limited. The last of the extension handle segments may have a magnet 134 inserted, bonded, or otherwise coupled into the widened opening 132*c*. The last extension handle segment may be referred to as a "tail handle segment."

The razor is intended to operate like the majority of manual razors on the market today where the user translates the razor across their face and the blade or blades cut hairs as the razor passes over them. While the design disclosed herein discusses a multi-bladed razor, the user may opt for a single blade shaving experience. As such, for ease of discussion, further description of the razor will be with respect to multiple blades. However, it is to be understood that the razor can be configured by the user to contain only a single razor blade thus creating an experience closer to that of a classic safety razor. One advantage of using this razor in the single blade configuration over a classic safety razor is the handle grip. The grip may have two flat spots or only slightly curved surfaces near the shaving end of the razor to allow for a better pinch grip than on a round handle. Another advantage is the pivoting mechanism reduces the skill level required to use the razor and helps provide a more comfortable shave. The guard may also reduce the skill level required to use the razor and help provide a more comfortable shave.

The user first assembles the head by stacking spacers and razor blades on the pins that may be attached to the cap, using any quantity or arrangement of spacers and blades that the user believes will provide them with the best shaving experience. They then slide the base on the pins and attach the female fastener(s). They then thread down the nut to tighten the head and compress the assembly or stack of spacer(s) and razor blade(s) together. The user can verify the blades are sitting in the proper position by checking that all of the razor blades in the cutting stack are in contact with the two prongs that are closest to shaving plane. The prongs act both as a reference plane for guiding the blades and as a visual guide. Any misalignment of the razor blades would cause a gap between the prongs and the razor blades. A gap between two surfaces is easier to see than the misalignment of the blades and how far they are out of alignment with an invisible plain. This allows the user to quickly detect any problems and reduces the chances of any injury. If the alignment were made by only using the two internal pins, the user would have no visual reference to check if the blades seated in the correct position in the head.

Generally speaking, the spacers and razor blades will alternate in the stack but the user could opt not to. For example, the user could opt to put two spacers to create a bigger gap for better hair evacuation and easier cleaning of the razor. The user could also opt to increase the number of razor blades for a closer shave. If the user wishes to save money or just reduce the waste generated by their shaving, they could opt to use fewer razor blades. While the blades are generally considered to be disposable, the spacers are reusable and thus help reduce landfill waste.

For people who desire a very close shave, multi-blade razors can get very close due to a process called hysteresis. As each blade passes, the hair is pulled out a little bit before it is cut. This leaves a little bit more hair exposed for the next blade to cut. On cartridge razors, the more blades they have, the smaller the gap between the blades tends to be. The finer the spacing of the blades, the less room the skin has to stick up between the blades. This reduces the chances of the user getting cut. For people with sensitive skin who get a lot of razor bump, a more conservative shave can be desirable. For these applications, fewer blades with less aggressive hair cutting may be desired. The razor described herein has the ability to be adjusted by the user to take advantage of both situations without the user running out to the store to buy a different razor or cartridge. The number and spacing of the blades is may be optimized by the individual user. A stack of spacers, where each individual spacer's thickness can be anywhere from 0.001" up to 0.100", is used with razor blades that are identical in shape to the other razor blades in the stack. The spacers may have recesses to allow for more debris to move away from the cutting edge of the razor blades. The blades and spacers are stacked by the user instead of at the factory to help reduce the cost to the end user.

When the user pushes the head of the razor against their skin, the razor will rotate about the pivot to orient the razor parallel to the skin at the guard. The guard absorbs a large portion of the pressure reducing the chances of the user using excessive pressure and cutting themselves. The spring helps orient the head and keep the blades in contact with the skin with the right amount of pressure. If the spring starts to wear out, the user can turn the knob on the spring plunger to partially compress or preload the spring in the spring plunger. According to Hooke's law, the more a spring is compressed, the stronger the force it produces. This allows the user to compensate for a wearing out spring or provide more pressure for their shaving experience. If the spring were to be damaged, the user can replace the spring by simply unscrewing the spring plunger all of the way and threading back in a replacement. In this embodiment, no tools are required for the replacement of the spring plunger. Other embodiments of spring plungers may require a tool to install or set their installation depth.

The handle segments may be threaded together. A variety of shapes and diameters of the extension handle segment can be used together to allow the user to customize the grip. For example, if a user has big hands, they could purchase one or more larger diameter extension handle segments to make the razor easy to hold. If the user desires a longer handle, they can install additional extension handle segments.

A magnet may be used in the final or tail segment of the handle. The tail segment may be used to hold the razor in an upright position by sticking the magnet to a ferromagnetic surface or item already owned by the user. This may be as simple as a metal box. It may also be used to hang the razor upside down from a ferromagnetic surface such as a metal cabinet, towel holder, screw, or other metallic object. This saves the need for a stand and thus reduces the amount of waste that ends up in landfills. When loading razor blades into the razor, it is easy for the user to cut or injure themselves. The magnet on the handle may be used to pick-up razors off of surfaces. The handle segment with the magnet in it may be disconnected and used to pick up razor blades and set them onto the pins. To release the razor blades from the magnet, the user only has to slide the razor blade part way down the pins and drag the magnet tangentially away from the razor blade. The razor blades will be caught on the pins and will fall down into position when the magnet is removed.

Figure 11:
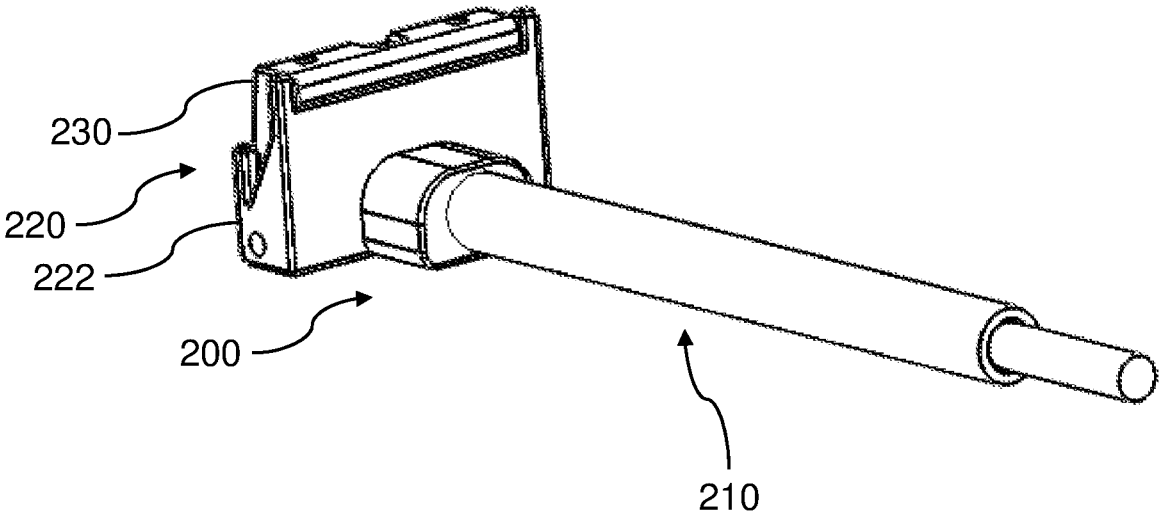
FIG. 11 presents an isometric view of an embodiment of a hair shaving instrument with a variable number of blades and a piston handle.

FIG. 11 is an embodiment of a razor 200 with a piston or plunger handle 210. The piston handle is shown rigidly attached to the head 220 but in alternate embodiments, a pivoting connection with a flexible tube or hose could connect the piston handle to the head. In another embodiment, pivoting connector with a fluid channel through the center of a pivot could be used. In an alternate embodiment, the piston handle 210 could be connected behind the blades to allow the product to flow over the blades and come directly out where the blades are. In another alternate embodiment, the piston handle 210 could be connected to the cap 230 of the head instead of the base 222.

Figure 12:
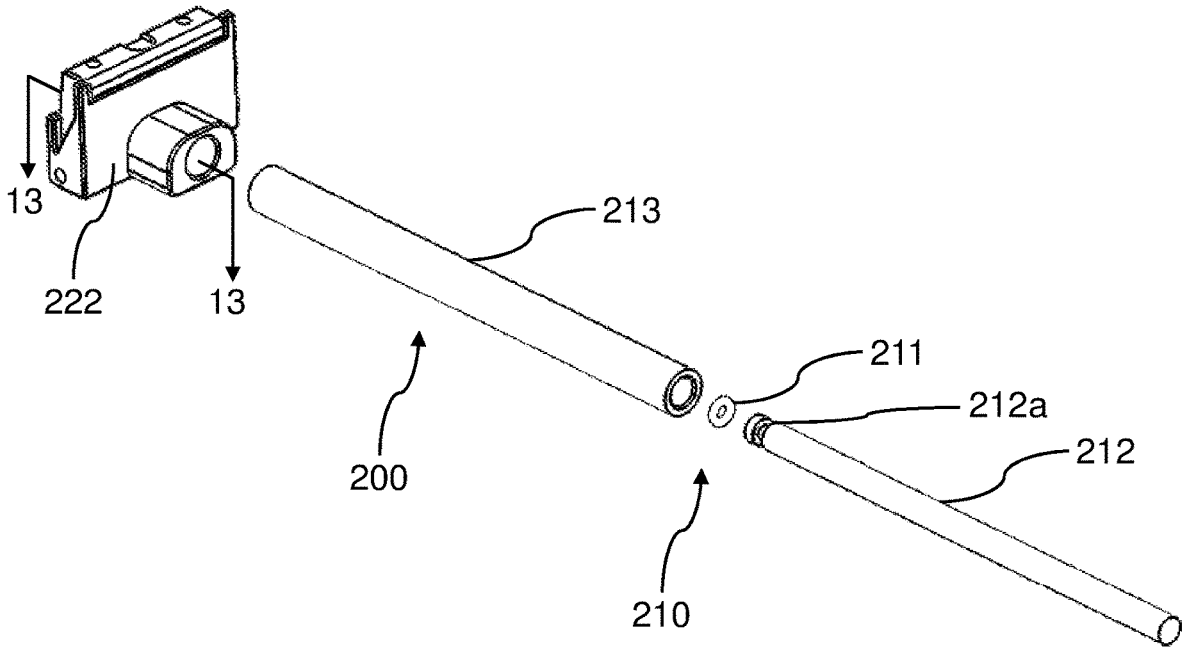
FIG. 12 presents another view of the hair shaving instrument of FIG. 11 where the handle is shown as an exploded view.

FIG. 12 is shows an exploded view of one possible embodiment of the piston handle 210. The piston handle is made up of an o-ring 211 that sits in a groove 212*a* on a piston rod 212 inside a cylinder or barrel 213. An alternate embodiment might use a piston assembly similar to a syringe where a rubber dome shaped piece acts as the sealing component. There are a large number of ways to make a piston assembly and the scope is not intended to be limited herein.

The piston is designed to hold and deliver a cream, gel, or fluid to the head of the razor for lubrication or comfort purposes. A cavity, hollow section, hollow part, or hollow portion of the handle is used to store the cream, gel, or fluid until the piston rod is pushed in. Shaving cream or gel is the primary intended product but other products can be delivered using the same mechanism such as but not limited to preshave oils, after shave lotions, after shave oils, and aloe.

Figure 13:
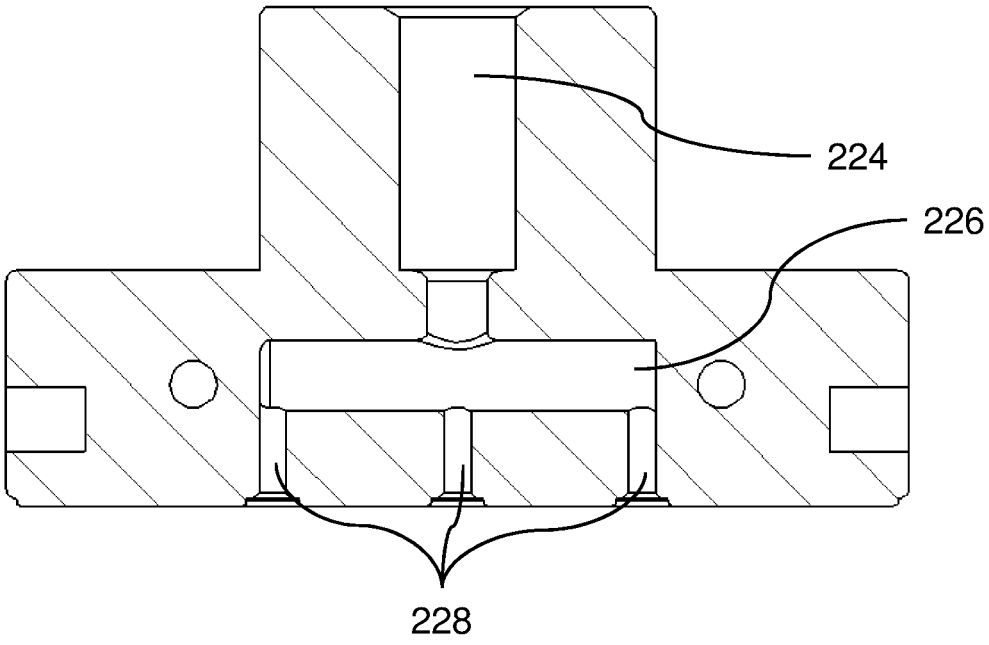
FIG. 13 presents a cross-section view of the base of the head of the hair shaving instrument of FIG. 12.

FIG. 13 is a cross sectional view of base 222 (as shown in FIG. 12). Passages run from the end of the piston handle, to the base's inlet connector 224. The inlet connector 224 leads to a manifold 226 inside the base where the flow splits to go to multiple openings 228 in the face or front of the razor. The face of the razor is the side of the razor that does the cutting. These openings allow the user to disperse the product at the leading edge of the razor. In this embodiment, this delivery system could be used to deliver shaving cream or other lubricant products directly where needed instead of the user having to apply it all over their face. This may cut down on wasted shaving cream and allow for continuous lubrication when going over the same spot more than once.

Figure 14:
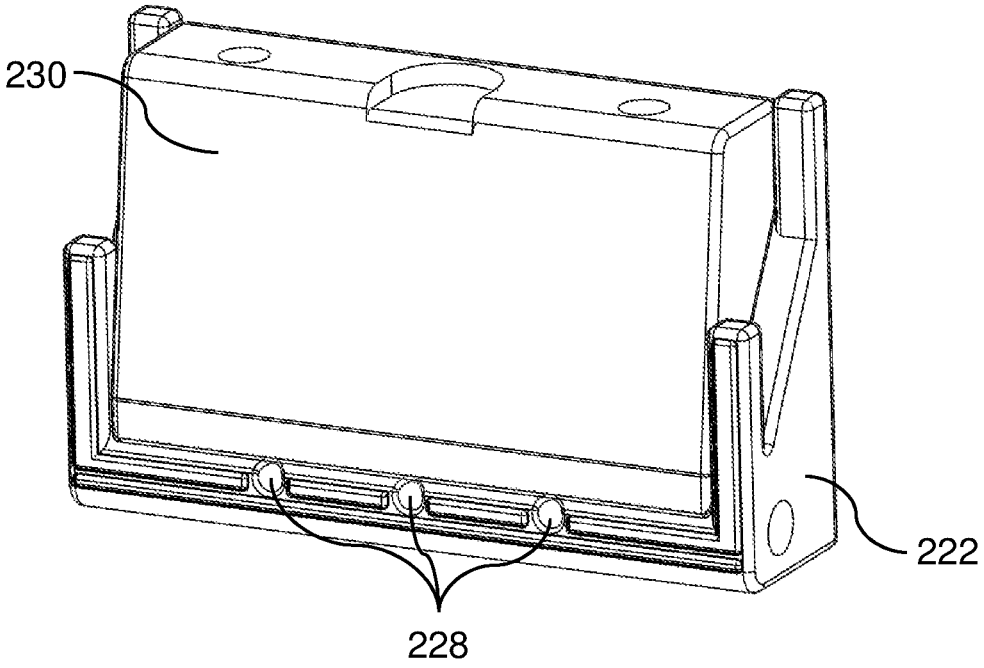
FIG. 14 presents an isometric view of the cap and base of FIG. 11 from another angle.

FIG. 14 presents an isometric view of the cap 230 and base 222. The desired product is delivered out openings 228 to the leading edge of the razor 200 (as shown in FIG. 11.)

In said embodiment, the piston rod may be drawn back with the head submerged in the product desired to be used in the razor. Pulling back the piston rod creates a vacuum in the handle which causes the product to be sucked backwards through the openings in the head of the razor through the manifold and into the handle. This will fill the piston's cavity similar to how a medical professional fills a syringe. Alternatively, the piston rod may be removed and the product added directly into the opening. The rod can then be reinstalled by pushing it back in part way into the opening.

To apply the product, the user pushes the piston rod. This forces the product out of the handle into the head through the manifold, where it is split into multiple flow paths, and out the openings in the face of the razor. The razor may then be translated across the desired area to be shaved. The user may push more product from the piston assembly as necessary to maintain the optimal comfort and performance level. This process eliminates the need for washing any product off of the user's hands after application. It also makes it easier to reapply product if going over the same area more than once.

A razor according to the present disclosure may provide many advantages. For instance, it may be used in a large number of configurations without replacing the whole razor. This greatly cuts down on waste going to landfills. It allows the user to rapidly try a bunch of different configurations and to shave with a configuration that is optimized for them instead of a standard configuration. It uses inexpensive blades and by stacking them can produce a similar shave to cartridge razors but without all of the cost that goes into assembling the cartridge heads at the factories. The pivot and spring reduce the skill required to use the razor by automatically setting the correct angle between the blades and the skin. The adjustable spring and replaceable spring plunger will save many handles from going to the landfills when the rest of the handle is still usable. The reconfigurable handle allows each razor to be customized to the user's hands. The magnet eliminates the need for a stand and can be used as a safety tool. The hollow handle and passages through the head reduce the mess from shaving.

In light of the principles and example embodiments described in the present disclosure by text and/or illustration, one with skill in the art will recognize that the described embodiments can be modified in arrangement and detail without departing from the principles described herein. Furthermore, this disclosure uses expressions such as "one embodiment" and "another embodiment" to describe embodiment possibilities. However, those expressions are not intended to limit the scope of this disclosure to particular embodiment configurations. For instance, those expressions may reference the same embodiment or different embodiments, and those different embodiments are combinable into other embodiments. In view of the wide variety of useful permutations that may be readily derived from the example embodiments described herein, this detailed description is intended to be illustrative only, and should not be construed as limiting the scope of coverage.

What is claimed is:

1. A razor comprising:

a head with a base, a cap, and one or more male fastening elements extending between the cap and the base, wherein the base comprises a bottom side, a back side that abuts the bottom side, a front side that abuts the bottom side, and a top side that abuts the front side and the back side, wherein the top side abuts the front side at an angle that is not 90 degrees, wherein the top side comprises four corners comprising two front corners and two rear comers;

a cutting stack comprising at least three blades and at least four spacers;

multiple prongs in the head to retain razor blades in fixed positions between the base of the head and the cap of the head when the cap and the base are connected together, wherein the multiple prongs comprise (a) a first front prong that extends upwards from one of the front corners of the base and (b) a second front prong that extends upwards from the other front corner of the base, wherein the first front prong and the second front prong extend upward for a length at least equal to a thickness of the cutting stack, and wherein the first front prong has a linear rear surface that is aligned with a linear rear surface of the second front prong to define a contact plane and that is positioned to abut a tab on one side of each of the at least three razor blades in the cutting stack, to align cutting edges of the at least three razor blades in a cutting plane by contacting the tabs on the at least three razor blades and aligning the tabs in the contact plane, and wherein the first front prong and second front prong are positioned to abut corners located on opposite sides of the cutting edges of the at least three razor blades to substantially prevent lateral motion of the at least three razor blades;

one or more female fastening elements to receive one or more male fastening elements, the one or more male fastening elements and the one or more female fastening elements to connect the cap of the head to the base of the head, wherein the one or more male fastening elements and the one or more female fastening elements form an adjustable length clamp to provide clamping force to hold the cutting stack in place, wherein the clamping force can be removed by a user to enable the user to customize a number of razor blades and a number of spacers in the cutting stack for the head, wherein the one or more male fastening elements comprise a fully threaded rod comprising a threaded section that extends from one end of the rod to an opposite end of the rod, and wherein the one or more female fastening elements comprises an internally threaded nut; and a handle connected to the head via a pivoting joint;

wherein the head comprises an integral guard comprising a surface that extends out at least to the cutting plane of the cutting edges of the at least three razor blades, wherein the surface of the integral guard comprises at least three elements comprising a front surface of the first front prong, a front surface of the second front prong, and a front surface of a portion of the head that extends between the first front prong and the second front prong, wherein the front surfaces of the first and second front prongs are parallel to the contact plane;

wherein the one or more male fastening elements and the one or more female fastening elements enable the user to remove the cap of the head from the base of the head without any tools; and wherein the one or more male fastening elements and the one or more female fastening elements enable the head to accommodate an adjustable number of razor blades and an adjustable number of spacers in the cutting stack.

2. The razor according to claim 1, further comprising:

at least one spacer of the at least four spacers comprising three or more points.

3. The razor according to claim 1, further comprising:

an externally threaded spring plunger in the handle; and wherein:

the base of the head comprises one or more recesses to receive the one or more female fastening elements;

the cap of the head comprises the one or more male fastening elements;

the handle comprises multiple segments, including a root handle segment and multiple extension handle segments;

the root handle segment comprises a first end, a second end opposite the first end, and a threaded aperture, wherein the first end comprises the pivoting joint, wherein the second end comprises a threaded female connector, and wherein the threaded aperture is sized to receive the externally threaded spring plunger and the threaded aperture is aligned to cause the tip of the externally threaded spring plunger to abut the back side of the base of the head and push the back side of the head towards a predetermined angle relative to an axis of the handle when the externally threaded spring plunger is installed in the head; and at least one of the multiple extension handle segments comprises (a) a first end with a threaded male connector that corresponds to the threaded female connector of the root handle segment and (b) a second end with a threaded female connector that is axially aligned with the male connector of the first end and has a thread that corresponds to the threaded male connector of the multiple extension handle segments, wherein the threaded female connector of at least one of the multiple extension handle segments comprises an opening with a threaded section, an unthreaded section, and a transition between the two sections, wherein the unthreaded section of the female connector is sized to receive a magnet with a circular cross-section and to act as a guide to help align any threaded male connector of the multiple extension handle segments to reduce chances of cross threading during assembly, wherein the unthreaded section has a larger diameter than the minor diameter of the threaded section and the transition between the unthreaded section and the threaded section can serve as a back stop for the magnet; and the externally threaded spring plunger comprises an externally threaded body and a spring to drive the head to a first orientation with the predetermined angle relative to the axis of the handle, wherein the externally threaded spring plunger enables the user to adjust how much force is applied to the head by the spring by rotating the externally threaded body further into or out of the threaded aperture in the root handle segment, and the externally threaded spring plunger can be replaced by the user without any tools.

4. The razor according to claim 3, wherein:

the multiple extension handle segments comprise a tail segment;

the tail segment comprises a first end with a threaded male connector that corresponds to the threaded female connector of the root handle segment; and the tail segment further comprises a second end opposite said first end, and a magnet attached to the second end.

* * * * *